US005080179A

United States Patent [19]

Gien et al.

[11] Patent Number: 5,080,179

[45] Date of Patent: Jan. 14, 1992

[54] DOWN THE HOLE HAMMER EQUIPMENT

[75] Inventors: Abraham Gien, Groot Marico; Bernard L. Gien, Sandton, both of South Africa

[73] Assignee: P. G. Drilling Equipment & Accessories, Edenvale, South Africa

[21] Appl. No.: 539,684

[22] Filed: Jun. 18, 1990

Related U.S. Application Data

[63] Continuation of Ser. No. 356,788, May 24, 1989, abandoned.

[30] Foreign Application Priority Data

Jun. 15, 1988 [ZA] South Africa ..... 88/4259

[51] Int. Cl.[5] ..... B25D 17/00; E21B 1/00

[52] U.S. Cl. ..... 173/17; 173/73; 173/78; 173/80

[58] Field of Search ..... 173/17, 73, 78, 80, 173/136, 138, 79

[56] References Cited

U.S. PATENT DOCUMENTS

| | | | |
|---|---|---|---|
| 2,958,645 | 5/1976 | Curington | 173/17 |
| 4,084,647 | 4/1978 | Lister | 173/80 X |
| 4,530,408 | 7/1985 | Toutant | 173/17 |
| 4,591,004 | 5/1986 | Gien | 173/17 |
| 4,753,302 | 6/1988 | Gien et al. | 173/17 X |
| 4,936,393 | 6/1990 | Lister | 173/17 X |

*Primary Examiner*—Frank T. Yost
*Assistant Examiner*—Rinaldi Rada
*Attorney, Agent, or Firm*—McAulay Fisher Nissen Goldberg & Kiel

[57] ABSTRACT

The invention is concerned with pneumatic percussion drilling equipment with advantageous manufacturing simplicity and effective piston area to casing size consisting essentially of an elongate hollow casing housing a piston assembly and having a backhead at one end with a compressed fluid inlet, a bit assembly with a compressed fluid exhaust at the other end, and the backhead including a seal for a backhead end of the piston reciprocatable within the casing, the piston having axial bores extending inwardly from each end, inclined passages extending away from the inner ends of the axial bores to open through the wall of the piston at positions axially displaced from each other and towards opposite ends of the piston from their respective axial bores, and the casing walls having axially spaced apart recesses, the backhead seal, casing recesses and opening through the wall of the piston being such as to allow fluid under pressure introduced axially into the casing through the backhead, to reciprocate and to maintain a constant pressure on the piston in an inoperative position remote from the backhead.

20 Claims, 1 Drawing Sheet

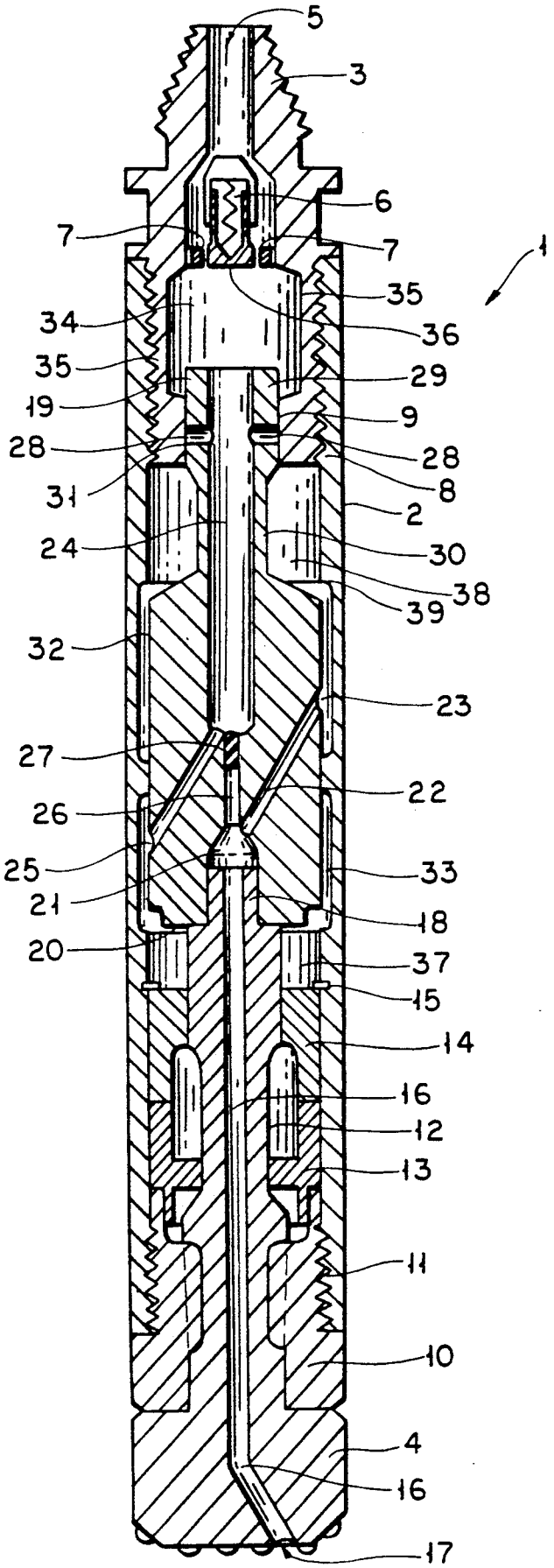
5
3
6
7
7
1
35
34
36
35
29
19
9
28
28
31
8
2
24
30
38
39
32
23
27
22
26
25
33
21
18
20
37
15
14
16
12
13
11
10
4
16
17

DOWN THE HOLE HAMMER EQUIPMENT

This is a continuation of application Ser. No. 07/356,788, filed May 24, 1989, now abandoned.

This invention relates to pneumatic percussion machines, and particularly to such machines which are suitable for use as compressed fluid pneumatic drilling hammers.

In particular the invention relates to machines of the type disclosed in our South African Patent No. 84/3758 and to a construction which provides for simplicity of manufacture and also a greater effective piston area for a predetermined casing size.

In accordance with this invention there is provided a pneumatic percussion drilling machine comprising an elongate hollow casing housing a piston assembly and having a backhead at one end with a compressed fluid inlet, a bit assembly with a compressed fluid exhaust at the other end, the backhead including a seal for a backhead end of the piston reciprocatable within the casing, and the piston having axial bores extending inwardly from each end, inclined passages extending away from the inner ends of the axial bores to open through the wall of the piston at positions axially displaced from each other and towards opposite ends of the piston from their respective axial bores and recesses in the wall of the casing spaced apart axially, the seal, recesses and openings through the wall of the piston being such as to allow fluid under pressure introduced axially into the casing through the backhead to reciprocate the piston and also allow a constant pressure on the piston in an inoperative position remote from the backhead.

Further features of the invention provide for the backhead end of the piston to be an extension of reduced diameter having an enlarged head at the free end, the head having at least one radially extending passage from the axial bore through the wall of the head at a location to be inwardly free of the backhead when the bit assembly is in an inoperative position or to be sealed by the backhead only when the piston is operatively positioned in the casing.

The invention also provides for the axial bores in the piston to be in communication with each other through passages for restricted fluid flow.

Preferably the communication between the axial bores is effected through a porous plug which allows continuous partial flushing of the bit assembly during normal use.

Also there will preferably be a plurality of inclined passages so the piston is a symmetrical construction.

The construction provides for there to be three chambers formed by co-operating sealing surfaces within the casing formed by the backhead, the casing bit assembly and piston surfaces, the chambers being opened and closed by the relative movement of the co-operating sealing surfaces, the first chamber being formed between the backhead and piston, the second chamber being formed between the bit assembly with the piston in contact with the bit assembly, and the third chamber being formed circumferentially around the piston between the first and second chambers.

The above and additional features of the invention are exemplified in the description below of one embodiment of the invention made with reference to the accompanying drawing, which is a cross-sectional side elevation of a drill hammer according to the invention.

As illustrated, a percussion drill hammer 1 comprises an elongate hollow cylindrical casing 2 having a backhead 3 at one end and a drill bit assembly 4 at the other end. The backhead 3 has an axial opening 5 for a compressed fluid inlet, which leads to a spring check valve assembly 6 and through narrow passages 7 into the interior of the backhead. The end 8 of the inner wall backhead 3 of is stepped to form a sealing surface 9.

At the other end of the casing, the drill bit 4 is held in a chuck 10 which is secured in the end of the casing by means of screw threading 11. The drill bit has a stepped annular recess 12 in the length of its shaft, and a bit retaining ring 13 is provided between the internal end of the chuck and a guide bush 14. This bit retaining ring has an inwardly stepped shoulder which seats in the annular recess 12 allowing the bit to slide axially within the axial length of the recess. The bit is thus, restrained at each end of its movement by the retaining ring 13. The guide bush 14 is secured at its uppermost end by a circlip 15. The drill bit assembly has an axial opening 16 which is open to the atmosphere at the drill head 17. Cooperating splines are provided in the chuck 10 and on the drill bit in a conventional manner. The inner end of the drill bit has a inwardly stepped end section 18.

A piston which forms the hammer of the drill is provided to reciprocate within the casing ends and has a backhead end with an enlarged head 19 and a bit assembly end 20 which comprises the striking end for striking the internal end of the bit.

The striking end of the piston has a central bore 21 which fits in sealing and sliding engagement around the stepped portion 18 of the internal end of the bit. The striking surface 20 of the piston thus strikes against the stepped portion of the inner end of the bit.

The central bore 21 has one or more inclined passages 22 which extend away from the striking end at an angle to the piston axis to exit at the periphery of the piston in the middle region 23 thereof.

The backhead end of the hammer also has an axial bore 24 and from its internal end also has one or more inclined passages leading away therefrom to exit through the piston wall at position 25 removed from the striking surface 20 at the striking head end of the piston.

The base of the axial bore 24 of the piston is made to communicate with the central bore 21 of the striking end of the piston, through a passageway 26 which can be wholly or partially blocked by the insertion into it of a solid or porous plug 27.

The backhead end of the hammer has an axial extension of reduced diameter terminating in an enlarged head 19. This head 19 fits in sealing engagement in the surface 9.

Extending laterally from the axial bore 24 in the head 19 of the hammer are one or more passageways 28 which exit at the sealing surface 9.

Three sets of sealing formations between the piston and the remainder of the drill are thus provided. The first set is located at the backhead end of the assembly and comprises the surface 29 of the head 19 which extends radially from the inwardly stepped section 30 of the extension of the hammer. This surface 29 slides within the stepped portion 31, the inner wall of the to form the said first set. When the surface 29 is located within the stepped portion 31, a sliding seal is provided between casing and piston.

Towards the middle region of the casing, two inwardly stepped annular recesses, one 32 relatively close to the backhead end of the casing and the other 33 further towards the bit assembly are provided. The inner surface of the casing between these recesses and at the backhead end together with the outer wall of the hammer form a second set of second set of sealing formations. These, co-operate during reciprocation to alternately open and seal compressed fluid pathways which run through the hammer. These comprise the second set of sealing formations.

The last set of sealing formations comprise the surface of the inwardly stepped portion 18 of the bit and the surface of the axial bore 21, the stepped portion 18 being in sealing engagement with the bore.

Three chambers in the drill assembly are formed between the casing, piston, backhead and bit assembly, to be opened and sealed by the sets of sealing formations at different positions of piston reciprocation.

The first chamber 34 is defied by the backhead side inner walls 35, the backhead end wall 36, the backhead end 19 of the piston and the axial bore of the piston 24.

The second chamber 37, is formed at the bit assembly end of the drill, between the external end of the bit, the casing wall, and the striking head end of the piston 20.

A third chamber 38 is formed adjacent the first chamber 34, and is defined by the casing walls and the outwardly stepped surface 39 of the hammer extending radially from inner end of the extension remote from the head 19.

A first fluid supply passage passes from the backhead inlet 5 into the first chamber 34, through the axial bore 24 and inclined passages and out of exit 25 thereto, into the second chamber 37.

A second fluid supply passage passes from the backhead inlet 5 into the first chamber 34, passed the head 19 into the third chamber 38 when the piston is in a position where the head 19 is located in chamber 34 and free of surface 9.

A first fluid exhaust path from the second chamber passes between the third set of sealing formations at the bit assembly end of the piston when the drill bit 18 is free from the piston end, and thence to the drill bit exhaust passage 16. The second fluid exhaust passage from the third chamber, passes through the second set of sealing formations, when the piston is in the striking position illustrated, into the stepped annular recess 32, into the opening 23 and along the inclined passage 22 into the axial bore 21 at the bit end of the piston, and from there into the exhaust passage 16 of the bit.

In use, with the piston at the bit end of the casing in contact with the internal bit end, as shown the second chamber 37 is formed around the stepped portion of the bit, and the recess 33 between the piston and casing. This chamber and is open only to the exit 25 of the first fluid passage, the third set of sealing formations sealing off the exhaust passage from this chamber. In this position, compressed fluid entering the backhead inlet follows the first fluid supply path to the third chamber to lift the piston towards the other end of the casing. Clearly the area of piston having an axial component of force which is exposed in the third chamber must be greater than the area of the equivalent portion of the piston exposed to compressed fluid in the first chamber for this to occur.

The first set of sealing formations between surfaces 29 and 31 are sealed during the initial movement of the piston towards the backhead end as the head 19 slides within the stepped portion 31 of the backhead.

As the piston travels further towards the backhead end, the bore of the bit end of the piston pulls out of engagement with the stepped portion 18 of the drill bit, and the first fluid exhaust passage is thus opened and air from the second chamber is exhausted through the bit assembly. At the same time, the exit 25 of the first fluid supply passages passes beyond the annular recess 33 of the bit assembly end of the casing to seal against the wall thereof between the recesses 32 and 33, thus cutting off the first fluid supply path to the second chamber.

The momentum of the piston carries it still further with the first fluid supply path closed and the compressed fluid in the first chamber 34 has a cushioning effect as the piston head 19 travels into this chamber.

After a predetermined movement the head 29 of the backhead end of the piston, passes the end of surface 9 of the backhead and the second fluid supply passage from the first chamber 34 to the third chamber 38 is opened. The effect of the compressed fluid on the piston end within the first chamber and on the exposed surfaces having an axial component thereon in the third chamber, then compel the piston to slide downward towards the bit. Soon after the piston commences its return movement, the first set of sealing surfaces 29 and 9 engage with each other to seal off the second fluid supply path and the piston continues towards the bit end under its momentum until the first fluid supply path is opened. This causes the third set of sealing around formations closes with the bit end of the piston bore sealing the stepped portion 18 of the bit assembly. Similarly, the second set of sealing formations separate, with the opening 23 then located opposite the annular recess 32. This opens the second fluid exhaust passage from the third chamber to the bit assembly. The piston continues to reciprocate repetitively in the above manner.

The construction enables a position of the piston is to be reached in which the bit is inactive and still receive a supply of compressed fluid. This occurs when the hammer is lifted off the drilling surface and the bit 4 drops under the force of gravity as far as the bit retaining rings 13 will allow. In this position, the piston follows the bit untill the lateral passageways 28 extending from the axial bore 24 at the backhead end of the piston and are open into the first chamber 24. This allows compressed fluid to pass from the first chamber 34 into the third chamber 38 where it passes between the second set of sealing formations into the stepped annular recess 32, into the opening 23 and along the inclined passage 22 into the axial bore 21 and is exhausted through the exhaust passage 16 of the bit. Thus the whole of the compressed fluid supply is allowed to exhaust out of the bit assembly and no piston reciprocation occurs. Under these conditions, it will be appreciated that air pressure acts on surface 39 of the piston to hold it in engagement with the bit.

During piston reciprocation, if the plug 27 is porous the axial bore 24 at the backhead end of the piston with the axial bore 21 at the bit assembly end of the piston are connected so that compressed fluid is able to pass directly from the first chamber to the bit continuously to flush the bit. The porosity of the plug is such that sufficient pressure of the compressed fluid is maintained to reciprocate the piston.

The seal at the backhead end of the piston provided by the backhead end wall 8 may, in an alternative arrangement, be undercut at the casing end. This will enable the radial passages 28 through the head 19 to be omitted.

With this construction when the bit moves out of the casing under no load conditions the piston will move in the same direction and air will have a path to flow from chamber 34 between the undercut part of backhead end wall and head 19 into chamber 38 and so maintain pressure on the piston surface 39 as above described.

What is claimed is:

1. A pneumatic percussion machine comprising:

an elongate hollow casing housing a piston assembly and having a backhead at one end with a compressed fluid inlet, a bit assembly with a compressed fluid exhaust at the other end of said casing, said elongate hollow casing and said piston assembly each having a longitudinal axis coaxial with each other, said backhead including an end wall having a first sealing surface, said first sealing surface forming an inner circumferential surface having a longitudinal axis coaxial with said longitudinal axis of said piston assembly;

said piston assembly including a backhead end having a second sealing surface, said second sealing surface having an outer circumferential extent in mating relationship with said front sealing surface and having a longitudinal axis coaxial with the longitudinal axes of said elongate housing, said first sealing surface and said second sealing surface together providing a backhead seal for said backhead end of said piston with said backhead while being reciprocatable within said casing, said piston having axial bores extending inwardly from each of the ends thereof;

inclined passages extending away from the inner ends of said axial bores and having openings to open through the wall of said piston at positions axially displaced from each other and towards opposite ends of said piston from their respective axial bores, said casing wall having axially spaced apart recesses, said backhead seal, said casing recesses and said openings opening through the wall of said piston cooperating with each other to allow fluid under pressure introduced axially into the casing through said backhead, to reciprocate said piston and allow a constant pressure on said piston in an inoperative position remote from said backhead.

2. A pneumatic percussion machine as claimed in claim 1 including means providing a compressed fluid flow path for compressed fluid from the backhead to pass the backhead seal and flow through the inclined passages of the piston to exhaust through the bit, and providing an unimpeded flow path when the piston is in an inoperative position remote from the backhead.

3. A pneumatic percussion machine as claimed in claim 2 in which said compressed fluid flow path comprises at least one radially extending passage extending from the axial bore of the piston through the wall of the backhead end of the piston at a location inward of the free end of the backhead end.

4. A pneumatic percussion machine as claimed in claim 2 in which said compressed fluid flow path comprises a part of the length of the backhead seal having a decreased cross-sectional area.

5. A pneumatic percussion machine as claimed in claim 4, wherein said axial bores in said piston are in communication with each other through restricted passages.

6. A pneumatic percussion machine as claimed in claim 5, including a porous plug for providing communication between said axial bores.

7. A pneumatic percussion machine comprising:

an elongate hollow casing having a first longitudinal axis and housing a piston assembly, said longitudinal axis and piston assembly having a second longitudinal axis coinciding with said first longitudinal axis, including a piston having a backhead end forming a first sealing surface having a third longitudinal axis coinciding with said first and said second axes;

a backhead at one end of said hollow casing including a compressed fluid inlet and an end wall forming a second sealing surface having a fourth longitudinal axis coinciding with said first, second and third axes;

a bit assembly at the other end of said casing including a compressed fluid exhaust;

said piston backhead end being reciprocatable within said casing and together with said backhead forming a backhead seal between said first and said second sealing surfaces so that said piston backhead end is in sealing engagement with said backhead;

said piston having spaced ends and axial bores extending inwardly from each of the ends longitudinally of said piston;

passages extending away from the inner ends of said axial bores and having openings to open through a wall of said piston at positions axially displaced from each other and towards opposite ends of said piston from their respective axial bores;

said casing wall being provided with axially spaced apart casing recesses; and said backhead seal, said casing recesses and said openings together forming a passageway to allow fluid under pressure introduced axially into said casing through said backhead, to impart reciprocal action to said piston in an operative position remote from said backhead.

8. A pneumatic percussion machine as claimed in claim 7, including flow path means for compressed fluid from said backhead for passing the compressed fluid past said backhead seal and through said piston inclined passages to exhaust through a bit unimpeded when said piston is in an operative position remote from said backhead.

9. A pneumatic percussion machine as claimed in claim 7, including a compressed fluid flow path comprising at least one radially extending passage extending from said piston through the wall of said backhead end of said piston at a location inward of the free end of said backhead end.

10. A pneumatic percussion machine as claimed in claim 7, including a compressed fluid flow path comprising a part of the length of said backhead seal having a decreased cross-sectional area.

11. A pneumatic percussion drilling machine comprising:

an elongate hollow casing housing a piston assembly including a piston and having a backhead at one end with a compressed fluid inlet, and said casing having casing walls;

a bit assembly with a compressed fluid exhaust at the other end, and the backhead including a seal for a backhead end of the piston reciprocatable within the casing, the piston having two spaced ends and axial bores extending inwardly from each said end, and one of said spaced ends of said piston being a bit assembly end proximate to said bit assembly;

inclined passages extending away from inner ends of said axial bores to open through a wall of the piston at positions axially displaced from each other and towards opposite ends of the piston from their respective axial bores, said piston having openings through said wall, and the casing walls having axially spaced apart recesses, the backhead seal, said casing spaced apart recesses and said openings through the wall of the piston being such as to allow fluid under pressure introduced axially into the casing through the backhead, to reciprocate the piston and allow a constant pressure on the piston in an operative position remote from the backhead.

12. A pneumatic percussion drilling machine as claimed in claim 11, having a means providing a flow path for compressed fluid from the backhead, past the backhead seal for the piston and through the inclined passages towards the bit assembly end of the piston to exhaust through the bit, and said flow path being unimpeded when the piston is in an inoperative position remote from the backhead.

13. A pneumatic percussion drilling machine as claimed in claim 12, in which the flow path for compressed fluid comprises at least one radially extending passage from one of the axial bores of the piston through the wall of the backhead end of the piston at a location inward of an end of an inner wall of the backhead end.

14. A pneumatic percussion drilling machine as claimed in claim 12, in which the flow path for compressed fluid comprises a stepped part of the backhead wall at the casing end.

15. A pneumatic percussion drilling machine as claimed in claim 11, in which the axial bores in the piston are in communication with each other through a restricted passage.

16. A pneumatic percussion drilling machine as claimed in claim 15, in which the communication between the axial bores is effected through a porous plug.

17. A pneumatic percussion drilling machine as claimed in claim 11, including a flow path for compressed fluid from said backhead comprising at least one radially extending passage from one of the axial bores of said piston through the wall of the backhead end of said piston at a location inwardly of an end of an inner wall of the backhead end.

18. A pneumatic percussion drilling machine as claimed in claim 17, in which the axial bores in the piston are in communication with each other through a restricted passage.

19. A pneumatic percussion drilling machine as claimed in claim 18, in which the communication between the axial bores is effected through a porous plug.

20. A pneumatic percussion drilling machine as claimed in claim 11, wherein said backhead end of said piston includes an axial extension of reduced diameter, terminating in an enlarged head, and said backhead having a stepped inner wall to form with said axial extension said seal for the backhead end of said piston.

* * * * *